United States Patent [19]

Kelly

[11] Patent Number: 4,467,630

[45] Date of Patent: Aug. 28, 1984

[54] HYDRAULIC SWAGING SEAL CONSTRUCTION

[75] Inventor: John W. Kelly, Burbank, Calif.

[73] Assignee: Haskel, Incorporated, Burbank, Calif.

[21] Appl. No.: 331,672

[22] Filed: Dec. 17, 1981

[51] Int. Cl.[3] ..... B21D 22/10

[52] U.S. Cl. ..... 72/62; 29/421 R

[58] Field of Search ..... 72/60, 61, 62; 29/421 R, 157.3 L

[56] References Cited

U.S. PATENT DOCUMENTS

| | | | |
|---|---|---|---|
| 2,272,811 | 2/1942 | Nathan | 285/110 X |
| 2,508,286 | 5/1950 | Utis | 277/116.6 X |
| 2,903,310 | 9/1959 | Hill | 277/188 A X |
| 3,358,488 | 12/1967 | Fuchs, Jr. | 72/62 |
| 3,602,520 | 8/1971 | Wallis | 277/27 |
| 3,627,336 | 12/1971 | Lawson | 72/61 |
| 3,637,222 | 1/1972 | Wilkinson | 277/34 |
| 3,738,665 | 6/1973 | Bilco | 272/27 X |
| 3,977,068 | 8/1976 | Krips | 29/421 R |
| 3,979,810 | 9/1976 | Krips | 29/157.44 |
| 3,982,765 | 9/1976 | Fichelscher | 277/53 |
| 4,010,960 | 3/1977 | Martin | 277/3 |
| 4,069,573 | 1/1978 | Rogers | 29/421 R |
| 4,123,068 | 10/1978 | Gorden | 277/27 |
| 4,125,937 | 11/1978 | Brown et al. | 29/157.4 |
| 4,159,564 | 7/1979 | Cooger, Jr. | 29/727 |
| 4,169,605 | 10/1979 | Nishimoto | 277/188 A |
| 4,186,927 | 2/1980 | Burton et al. | 277/27 |
| 4,196,912 | 4/1980 | Quitberg | 277/81 R |
| 4,210,991 | 7/1980 | Cooper | 29/421 R |

*Primary Examiner*—Leon Gilden

*Attorney, Agent, or Firm*—Pretty Schroeder Brueggemann & Clark

[57] ABSTRACT

A sealing member for use in a swaging apparatus includes an annular heel from which inner and outer lips extend to define an annular cavity. The outer lip has a first portion extending radially outwardly and axially away from the heel and a second portion extending radially inwardly and axially away from the first portion. In a relaxed condition, the inner lip is angled radially inwardly from the heel. This sealing member can be used on a swaging mandrel in combination with a harder back-up sealing member and a centering sleeve that carries a flange. The flange is tapered to a pointed edge and engages a conical back surface of the heel.

14 Claims, 7 Drawing Figures

HYDRAULIC SWAGING SEAL CONSTRUCTION

FIELD OF THE INVENTION

The present invention relates to hydraulic swaging and, more particularly, to a sealing member used with a swaging mandrel.

BACKGROUND OF THE INVENTION

There are a variety of situations in which it is desired to expand a metal tube radially to form a tight, leak-proof joint with a surrounding structure. For example, large heat exchangers, particularly the type used in the steam generators of nuclear power plants, often employ a tube sheet, which is a metal plate as much as several feet in thickness through which hundreds of stainless steel or carbon steel tubes must pass. The tube sheet is initially fabricated with through holes of a suitable diameter in which the tubes are inserted. The tubes are then expanded against the sides of the holes by plastic deformation to seal the small crevices that would otherwise exist around the tubes. If these crevices were allowed to remain, they could collect corrosive agents, and would, therefore, decrease the predictable life-expectancy of the equipment.

The traditional technique for expanding tubes radially employs mechanical rolling. There are, however, a number of significant disadvantages associated with this technique. For example, mechanical rolling causes elongation of the tube with an accompanying decrease in the thickness of the tube walls. In addition, it is a time-consuming process that is difficult to employ in the case of longer tubes. The use of rolling also imposes a minimum dimension on the inside diameter of the tube in relation to the tube wall thickness, since it must be possible to insert rollers large enough to have suitable strength and rigidity.

For the above reasons, efforts have been made to develop techniques for expanding tubes by the application of hydraulic pressure. According to this newer technique, a mandrel is inserted in the tube and a pressurized working fluid is introduced through the mandrel into a small annular space between the mandrel and the tube. Fluid must be confined within the tube between two seals that surround the mandrel.

Since it is often necessary to swage large numbers of tubes as part of a single operation, ease of insertion of a swaging mandrel in the tubes is an important factor. Insertion, however, is usually difficult because the mandrel must carry seals that engage the inner surface of the tube tightly enough to prevent leakage of the working fluid. Tolerance variations between tubes result in greater difficulties when a seal large enough to work with the largest tubes must be inserted in the smallest tubes.

In some previously known hydraulic swaging mandrels, the sealing member that comes into direct contact with the working fluid has been an O-ring. In some instances, O-rings have been used in combination with a harder second sealing member.

An objective of the present invention is to provide a highly effective sealing member for use in a swaging apparatus that facilitates insertion of the mandrel. Another objective is to provide a mandrel in which such a seal cooperates advantageously with a centering mechanism.

SUMMARY OF THE INVENTION

The present invention relates to a sealing member for use in swaging apparatus that accomplishes the above objectives. It has a body of deformable elastic material that includes an annular heel and inner and outer lips extending from the heel. An annular cavity that opens in a generally axial direction is formed between the lips.

The outer lip, which may be V-shaped, has a first portion extending radially outwardly and axially away from the heel and a second portion extending radially inwardly and axially away from the first portion. The second portion facilitates radially inward compression of the sealing member to permit insertion thereof in a cylindrical opening. This lip construction also facilitates radial expansion of the sealing member under pressure to maintain a fluid-tight interface with a surrounding structure as that structure deforms outwardly.

The inner lip, when in a relaxed condition, may extend radially inwardly and axially away from the heel. It has an edge at the end farthest from the heel that is the portion of the sealing member closest to the center.

Preferably the heel is at least as long measured axially as it is high measured radially. It has a back surface, which may be conical, that extends radially outwardly and axially away from the annular cavity.

Another aspect of the invention relates to the inclusion of a sealing member, of the construction described above, in a swaging mandrel for confining a working fluid to an annular pressure zone within a tube. The mandrel includes a support encircled by the sealing member.

The mandrel may include two sealing devices which can advantageously be positioned within reduced diameter portions at opposite ends of the pressure zone. Each sealing device includes a sealing member of the construction described above and a harder back-up member disposed on the low pressure side of the sealing member. The back-up member encircles a sleeve that is slidable on the mandrel and performs a centering function. The sleeve carries a flange positioned between the corresponding sealing member and the back-up member. The flange is tapered to form a pointed outer circumferential edge. An inclined back surface of the heel of the first sealing member engages the flange. Preferably the mating surfaces are conical.

Other features and advantages of the present invention will become apparent from the following detailed description taken in conjunction with the accompanying drawings, which illustrate, by way of example, the principles of the invention.

DETAILED DESCRIPTION OF THE PREFERRED EMBODIMENT

Figure 1:
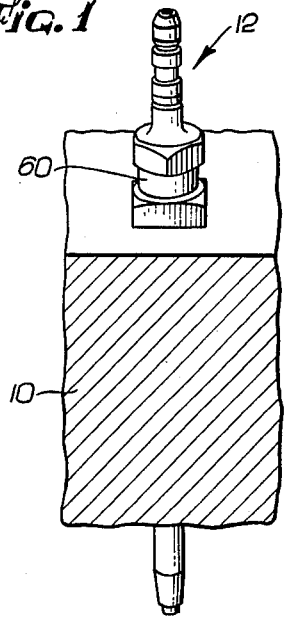
FIG. 1 is a perspective view of a fragmentary portion of a tube sheet through which a mandrel has been inserted.
Figure 2:
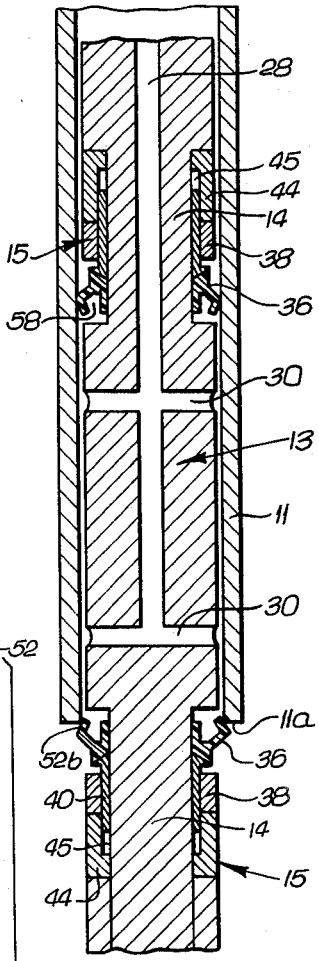
FIG. 2 is an enlarged cross-sectional fragmentary view of such a mandrel constructed in accordance with the present invention being inserted in a tube to be swaged, the head of the mandrel and the surrounding structure being omitted.
Figure 3:
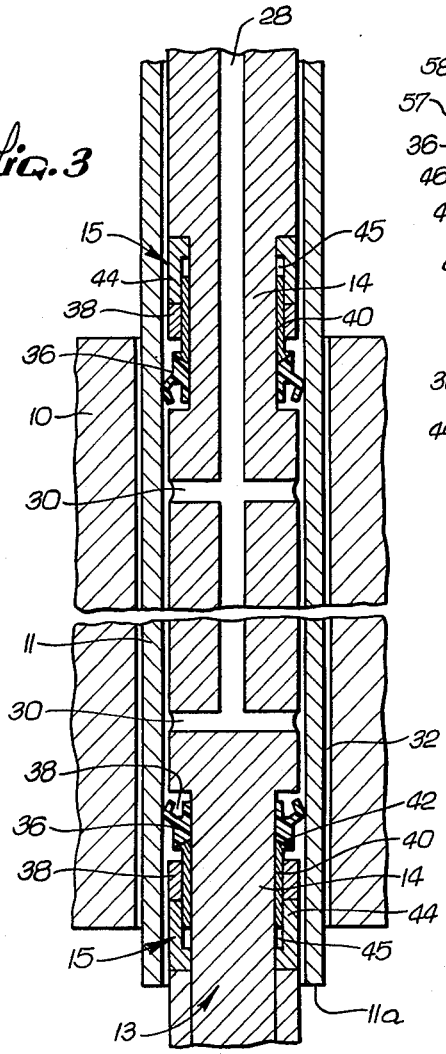
FIG. 3 is an enlarged, cross-sectional, fragmentary view of the mandrel of FIG. 2 after it has been fully inserted in the tube but before swaging pressure has been applied, the seals at both ends of the mandrel being shown, but the center portion of the mandrel being omitted.
Figure 4:
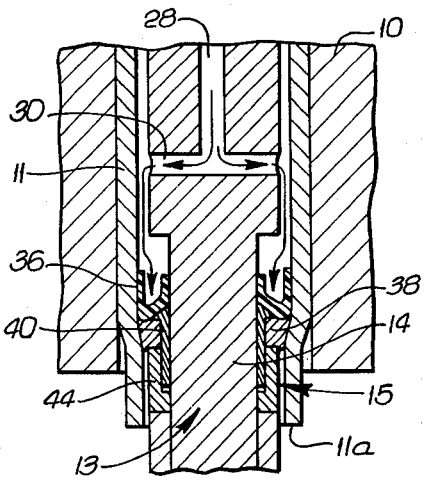
FIG. 4 is a view of a fragmentary portion of the mandrel of FIG. 2 (only one sealing device being shown) after the pressure has been applied.

A tube sheet 10, fragments of which are shown in FIGS. 1, 3 and 4, has a plurality of openings therein in which tubes 11 have been inserted. In accordance with known technology, and as illustrated in FIGS. 1–4 of the accompanying drawings, a mandrel 12 is inserted sequentially in each tube 11 to expand the tubes into firm contact with the inner surface of the corresponding openings. In FIG. 1, only one representative opening, filled by the mandrel 12, is included, and the internal tube 11 is not visible.

The mandrel 12 has an elongated body 13 with a groove-like portion 14 of reduced diameter at each end in which a sealing device 15 is located (see FIGS. 2, 3 and 4). A passage 28 for the supply of pressurized working fluid extends axially through the support 13 to two cross-bores 30 by which hydraulic working fluid can be introduced to an annular gap 32 between the mandrel body 13 and the interior surface of the tube 11 once the mandrel 12 has been fully inserted, as shown in FIGS. 1, 3 and 4.

Each sealing device 15 includes a sealing member 36 on the high pressure side and a back-up member 38 on the low pressure side. A centering sleeve 40 that slides axially on the mandrel support 13 is encircled by the back-up member 38.

Figure 7:
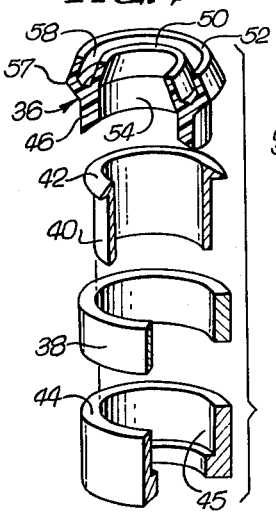
FIG. 7 is an expanded perspective view of a portion of the mandrel structure, the sleeve, the sealing member, and the back-up member, parts of these components being broken away to expose their cross-sectional configuration.

On the high pressure end of the sleeve 40 is a flange 42 that extends radially outwardly between the sealing member 36 and the back-up member 38. Thus, the back-up member 38 is confined between the flange 42 and an abutment portion 44 of the mandrel support 13 at the end of the reduced diameter portion 14. The abutment portion 44 is undercut to provide an annular space 45 into which the sleeve 40 can move axially away from the first sealing member 36 (see FIG. 7). It will be noted that while the sleeve 40 can move axially on the support 13, it cannot be cocked, i.e. moved angularly, with respect to the support because of its close sliding fit. The mandrel 13 is disassemblable, in a manner not shown in the drawings, so that the sealing member 36, the back-up member 38 and the sleeve 40 can be installed.

Figure 5:
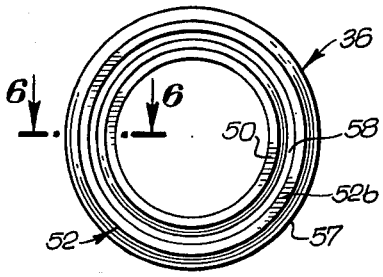
FIG. 5 is a plan view of one of the two sealing members of the mandrel.
Figure 6:
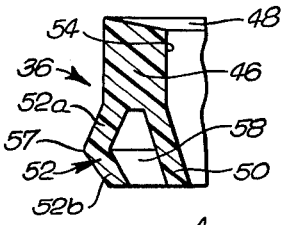
FIG. 6 is a cross-sectional view of the sealing member of FIG. 5, this veiw being taken along the line 6—6 of FIG. 5 and showing the member in a relaxed condition.

The heart of the present invention is the configuration of the first sealing member 36, best shown in FIGS. 5 and 6. It has an annular heel 46 that is rectangular in cross section except for an inclined conical back surface 48 that causes the heel to be wider at its outer diameter than at its inner diameter. The heel 46 is of substantial width even at its inner diameter where it is wider (measured axially) than it is high (measured radially).

When the mandrel 12 is assembled, the conical back surface 48 of the sealing member 36 abuts against a mating conical surface of the flange 42 on the sleeve 40. Since the flange 42 is tapered to a pointed circumferential outer edge, the center edge of the sealing member 36 meets the back-up member 38 when the flange 42 is pushed back against the second sealing member.

Extending from the side of the heel 46 opposite its back surface 48 is an inner lip 50 and an outer lip 52. The inner lip 50, when the sealing member 36 is in a relaxed condition, extends radially inwardly and axially away from an inner cylindrical surface 54 of the heel 46. Thus the inner lip 50 is pressed tightly against the support 13 once the sealing member 36 has been installed on the mandrel 12.

The outer lip 52 is generally V-shaped in cross section and has a first portion **52*a* that extends radially outwardly and axially away from the outer edge of the heel 46. A second portion 52*b* extends radially inwardly and axially away from the end of the first portion 52*a*, forming a sharp knee or bend 57 where the first and second sections meet. This knee 57 is the outermost position on the member 36. An axially opening annular cavity 58 is formed between the inner and outer lips 50 and 52**.

The preferred material for sealing member 36 and the back-up member is polyurethane, although other materials may also be usable. Polyurethane is elastomeric and has the desired memory characteristics, but it will deform plastically if applicable limits are exceeded thus destroying or reducing the effectiveness of the seal 15 when used again in another tube 11.

It has been found that a sealing member 36 having a hardness of 75 Shore A and a back-up member 38 having a hardness of 65 Shore D is a combination that can be made to work well. It will be understood, however, that these values are merely exemplary and are not limitations on the scope of the invention.

The use of the mandrel 12 equipped with the sealing devices 15 will now be explained. As the mandrel 12 is inserted, the end **11*a* of the tube 11 contacts the first portion 52*a* of the sealing member 36 of the first sealing device 15. The entire outer lip 52 is bent where it joins the heel 46 and moves closer to the support 13. This deformation of the sealing member 36 occurs with relatively little force and minimal resistance to insertion of the mandrel 12 is encountered. The corresponding back-up member 38 is of a small enough outside diameter that it does not contact the inside of the tube 11 when the mandrel 12** is centered.

When the sealing member 36 of the second sealing device to be inserted reaches the end **11*a* of the tube 11, as shown in FIG. 2, initial contact is made with the second portion 52*b* of the outer lip 52 which presents a surface to the tube that is inclined toward the center of the mandrel 12 and causes the entire outer lip to be deformed inwardly. Again, only minimal frictional resistance is encountered and the mandrel 12 is easily moved to the position shown in FIG. 3 in which the two sealing devices 15 are fully within the tube 11. A head 60 on the mandrel 12** causes it to come to a stop in the desired axial position.

Working fluid is then introduced through the passageway 28 and may ultimately reach a hydraulic pressure of 50,000 psi or more. Initially the working fluid is confined to the pressure zone only by the sealing members 36 which are in contact with the inner tube surface. The pressure forces the outer lips 52 against the tube 11 and the inner lips 50 against the mandrel 12, as shown in FIG. 4. The outer lip 52 remains in firm contact with the tube 11 to maintain a fluid-tight interface as the tube expands outwardly. The sealing members 36 move axially under the force of the fluid, pushing the sleeves 40 axially along the mandrel 12 into the spaces 45. The back-up members 38 are thus compressed between the flange 42 and the abutment 44 and caused to expand radially, closing off the annular gap surrounding the mandrel body 13 into which the sealing members 36 would otherwise deform inelastically.

Since the sleeve 40 can move only axially, the flange 42 must apply an equal compressive force component about the entire circumference of each back-up member 38. Moreover, since the second sealing member 38 fits tightly about the sleeve 40 it cannot move angularly. Therefore, the radial expansion of the back-up member 38 will be substantially equal about its entire circumference.

Even if the mandrel 12 is not centered within the tube 11 at the time the hydraulic pressure is initially applied, it is forced to assume a radially centered position defining a substantially uniform annular extrusion gap 32 on the low pressure side of the sealing device 15 due to the uniform expansion of the back-up members 38 in a radial direction. When the extrusion gap 32 is of a uniform dimension, the maximum gap width to which the back-up members 38 are exposed is only half the maximum gap width that could be encountered if the mandrel 12 were permitted to assume an off-center position in contact with the tube 11 at a single point on its periphery. It will, therefore, be found that plastic deformation of the back-up member 38 will not occur in the case of the present invention under circumstances that would result in such deformation if the gap were asymmetrical.

Another source of potential inelastic deformation of the sealing members 36 and the back-up members 38 is the possibility that they could be deformed into any void between the sealing members and the back-up members surrounding the flanges 44. The construction of the sealing devices 15 avoids the formation of such voids, however, since the sealing members 36 and the back-up members 38 come together at the pointed circumferential outer edge of the flange 44.

While a particular form of the invention has been illustrated and described, it will be apparent that various modifications can be made without departing from the spirit and scope of the invention.

I claim:

1. A swaging mandrel for confining a working fluid to a pressure zone within a tube whereby said tube can be expanded radially comprising:

a support to be positioned axially within said tube; and a pair of axially separated deformable sealing members encircling said support to be compressed axially and expanded radially upon the application of pressure thereto by said working fluid thereby defining boundaries of said pressure zone, at least one of said sealing members having an annular heel and annular inner and outer lips extending from said heel and defining therebetween an annular cavity that opens in a generally axial direction, said outer lip having a first portion normally extending radially outwardly and axially away from said heel and a second portion normally extending radially inwardly and axially away from said first portion, whereby said second portion facilitates radially inward compression of said sealing member to permit insertion thereof in a said tube, said outer lip facilitating radially outward expansion of said sealing member under pressure to maintain a fluid-tight interface with said tube.

2. The mandrel of claim 1 wherein said upper lip of said sealing member is generally V-shaped.

3. The mandrel of claim 1 wherein said lower lip of said sealing member when in a relaxed condition, extends radially inwardly and axially away from said seal, whereby said inner lip is pressed tightly against said support.

4. The mandrel of claim 1 wherein said heel is at least as long measured axially as it is high measured radially.

5. A swaging mandrel for confining a working fluid to a pressure zone within a tube whereby said tube can be expanded radially comprising:

a support to be positioned axially within said tube;

a deformable sealing member encircling said support to be compressed axially and expanded radially upon the application of pressure thereto by said working fluid thereby defining a boundary of said pressure zone, said sealing member having an annular heel and annular inner and outer lips extending from said heel and defining therebetween an annular cavity that opens in a generally axial direction, said outer lip having a first portion extending radially outwardly and axially away from said heel and a second portion extending radially inwardly and axially away from said first portion;

a deformable back-up member encircling said support to be compressed axially and expanded radially upon the application of pressure thereto by said working fluid, said back-up member being relatively hard compared to said first sealing member; and centering means for preventing angular movement of said back-up member relative to said support, thereby forcing said back-up member to assume a radially centered position within said tube as it expands radially and defining a substantially uniform circumferential extrusion gap adjacent said sealing member on the side thereof opposite said pressure zone.

6. The swaging mandrel of claim 5 wherein said centering means comprises a sleeve that is axially slidable on said support, said sleeve having a flange that extends radially outwardly, and said flange being disposed between said sealing member and said back-up member.

7. The swaging mandrel of claim 6 wherein:

said flange is tapered and forms a pointed outer circumferential edge; and said heel portion of said sealing member has an inclined back surface that engages and mates with said flange.

8. The swaging mandrel of claim 5 wherein said outer lip is generally V-shaped.

9. The swaging mandrel of claim 5 wherein said inner lip, when in a relaxed condition, extends radially inwardly and axially away from said heal.

10. The sealing member of claim 5 wherein said heel is at least as long measured axially as it is measured radially.

11. A swaging mandrel for confining a working fluid to a pressure zone within a tube whereby said tube can be expanded radially, said mandrel including a support to be inserted in said tube having two portions of reduced diameter and an abutment at one end of each of said portions, a passage within said support for introducing pressurized working fluid to said tube, and at least one outlet from said passage between said reduced diameter portions; wherein the improvement comprises two sealing devices each of which is disposed within one of said reduced diameter portions for confining said working fluid to a pressure zone extending axially along said support between said sealing members, each of said sealing devices comprising:

a sleeve encircling said mandrel and axially slidable thereon, said sleeve having a radially outwardly extending flange at one end thereof, said flange being tapered in a radially outward direction to form a pointed circumferential edge; and an elastically deformed sealing member encircling said support disposed adjacent to said flange, said sealing member having an annular heel that engages said flange and inner and outer lips extending from said heel and defining therebetween an annular cavity that opens away from said flange in a generally axial direction, said outer lip having a first portion extending radially outwardly and axially away from said heel and a second portion extending radially and axially away from said first portions; and an elastically deformable back-up member that is harder than said sealing member encircling said sleeve between said flange and one of said abutments on the opposite side of said flange from said sealing member, whereby pressure from said working fluid causes said back-up member to be compressed axially and expanded radially against said tube and said sleeve causes said back-up member and said support to assume a radially centered position with respect to said tube as said back-up member expands so that said support is surrounded by a substantially uniform circumferential extrusion gap.

12. The apparatus of claim 11 wherein said outer lip of each of said sealing members is generally V-shaped in cross section.

13. The apparatus of claim 11 wherein said inner lip of each of said sealing members, when in a relaxed condition, extends radially inwardly and axially away from said heel.

14. The apparatus of claim 11 wherein said heel and said flange of each of said sealing means includes mutually engaging conical surfaces.

* * * * *